US008584842B2

(12) United States Patent
Fakhouri et al.

(10) Patent No.: US 8,584,842 B2
(45) Date of Patent: Nov. 19, 2013

(54) STORAGE RECEPTACLE FOR SMOKING MATERIAL AND SYSTEM AND METHOD FOR USING SAME

(76) Inventors: Yazin Fakhouri, Chicago, IL (US); Robert J. Guyser, Chicago, IL (US)

( * ) Notice: Subject to any disclaimer, the term of this patent is extended or adjusted under 35 U.S.C. 154(b) by 30 days.

(21) Appl. No.: 12/924,169

(22) Filed: Sep. 21, 2010

(65) Prior Publication Data

US 2011/0068026 A1 Mar. 24, 2011

Related U.S. Application Data

(60) Provisional application No. 61/277,138, filed on Sep. 21, 2009.

(51) Int. Cl.
*A24F 23/04* (2006.01)
*A24F 23/00* (2006.01)
*B65D 85/10* (2006.01)

(52) U.S. Cl.
USPC ..... 206/236; 206/265; 206/256; 206/242

(58) Field of Classification Search
USPC ..... 206/244, 242, 248, 256–258, 260, 265, 206/276, 86, 85, 236–241, 38; 131/329, 131/178, 180, 187, 238, 231; 220/504
See application file for complete search history.

(56) References Cited

U.S. PATENT DOCUMENTS 498,695 A * 5/1893 Powell ..... 206/229
1,444,308 A * 2/1923 Dunning ..... 206/96
1,470,154 A * 10/1923 Draughon ..... 206/102
1,488,109 A * 3/1924 Gemeinhardt ..... 221/79
1,683,851 A * 9/1928 Wells ..... 206/236
2,006,773 A * 7/1935 Moore et al. ..... 224/235
2,939,575 A * 6/1960 Tarara ..... 206/86
3,144,152 A * 8/1964 Kopp ..... 215/6
3,451,533 A * 6/1969 Butler ..... 206/246
4,214,658 A * 7/1980 Crow ..... 206/244
4,223,687 A * 9/1980 Sandeen ..... 131/180
5,465,738 A * 11/1995 Rowland ..... 131/329
D366,950 S * 2/1996 McKinnie ..... D27/189
5,832,935 A * 11/1998 Heine ..... 131/329
5,848,596 A * 12/1998 Zelenik ..... 131/329
5,967,310 A * 10/1999 Hill ..... 206/242
6,112,889 A * 9/2000 Wicker ..... 206/213.1
6,155,452 A * 12/2000 Laurent ..... 220/739
6,244,434 B1 * 6/2001 Brooks ..... 206/236
6,290,059 B1 * 9/2001 Chuan ..... 206/238
6,736,143 B2 * 5/2004 Rennecamp ..... 131/240.1
6,814,081 B2 * 11/2004 Hasler ..... 131/235.1
7,717,259 B2 * 5/2010 Hatton ..... 206/236
2002/0066738 A1 * 6/2002 Agarwal et al. ..... 220/574.1
2003/0029744 A1 * 2/2003 Holler ..... 206/256
2007/0007150 A1 * 1/2007 Stacey ..... 206/38
2008/0314778 A1 * 12/2008 Hatton ..... 206/256

* cited by examiner

*Primary Examiner* — Steven A. Reynolds

(57) ABSTRACT

A storage receptacle for smoking material may open on two opposite sides. A bottom end of the storage receptacle may have a first cavity which may store the smoking material. A top end of the storage receptacle may have a second cavity which may store a pipe, a third cavity which may store a lighter and a fourth cavity which may store a cleaning pick. A top cover and a bottom cover may be removed from the top end and the bottom end of the receptacle, respectively. The top cover and the bottom cover may have teeth that may be used to grind, to divide and/or to separate the smoking material into smaller sizes. Threads may connect the top cover to the top end, the bottom cover to the bottom end, and/or the top cover to the bottom cover.

15 Claims, 14 Drawing Sheets

STORAGE RECEPTACLE FOR SMOKING MATERIAL AND SYSTEM AND METHOD FOR USING SAME

This application claims the benefit of U.S. Provisional Application Ser. No. 61/277,138, filed Sep. 21, 2009.

BACKGROUND OF THE INVENTION

The present invention generally relates to a storage receptacle for smoking material, such as, for example, tobacco or the like, and a system and a method for using the same. More specifically, the present invention relates to a storage receptacle that may open on two opposite sides. A bottom end of the storage receptacle may have a first cavity which may store the smoking material. A top end of the storage receptacle may have a second cavity which may store a pipe, a third cavity which may store a lighter and a fourth cavity which may store a cleaning pick. A top cover and a bottom cover may be removed from the top end and the bottom end of the receptacle, respectively.

Storage receptacles which have a cavity for a pipe and an additional cavity for smoking material are commonly known. Smoking a pipe may require certain tools, such as the pipe, and the storage receptacle may store one or more of the tools. Traditionally, the storage receptacle is a pocket-sized rectangular box, and the storage receptacle has a rectangular cavity for storing the smoking material and a cylindrical cavity for storing the pipe. Typically, one side of the storage receptacle has a cover that slides or twists open to reveal the two cavities.

A disadvantage of known storage receptacles is that the storage receptacle does not store all necessary tools for smoking the pipe. The storage receptacle stores the smoking material and the pipe; however, a user must then obtain matches or a lighter, for example. Thus, the user may not be able to smoke the pipe and the smoking material provided by the storage receptacle without the matches or the lighter.

To reduce the size and the weight of the storage receptacle, the pipe stored by the smoking receptacle has a small size. Use of the pipe requires insertion of the pipe into the cavity of the storage receptacle that stores the smoking material to pack the smoking material into the small pipe. For the smoking material to fit into the pipe, the smoking material must have a small size because the pipe has a small size. However, the smoking material is typically larger in size and is generally sold fresh and uncut. If the smoking material is bulky or leafy, the smoking material may not fit into the pipe. Thus, another disadvantage of known storage receptacles is that the storage receptacle does not provide a way to break and/or to divide the smoking material into smaller sizes.

Yet another disadvantage of known smoking receptacles is difficulty that is encountered to clean the pipe after use of the pipe. The smoking material burned during use of the pipe accumulates in the pipe and must be removed before the pipe receives fresh smoking material. A user may strike the pipe against a hard surface to remove the charred material. However, hitting the pipe on the hard surface may damage the pipe.

Therefore, a smoking receptacle having a storage cavity for a lighter, matches or other flame generating device is desirable. Further, a smoking receptacle having a way to grind, to divide and/or to separate the smoking material into a smaller size that may fit into the pipe is desirable. Still further, a smoking receptacle that stores a cleaning tool to remove charred material from the pipe is desirable.

SUMMARY OF THE PRESENT INVENTION

The present invention generally relates to a storage receptacle for smoking material, such as, for example, tobacco or the like, and a system and a method for using the same. More specifically, the present invention relates to a storage receptacle that may open on two opposite sides. A bottom end of the storage receptacle may have a first cavity which may store the smoking material. A top end of the storage receptacle may have a second cavity which may store a pipe, a third cavity which may store a lighter and a fourth cavity which may store a cleaning pick. A top cover and a bottom cover may be removed from the top end and the bottom end of the receptacle, respectively. The top cover and the bottom cover may have teeth that may be used to grind, to divide and/or to separate the smoking material into smaller sizes.

To this end, in an embodiment of the present invention, a storage receptacle for smoking material is provided. The storage receptacle has a cylinder having a top end and a bottom end wherein the bottom end is located in a position opposite to the top end; a first cavity in the bottom end which holds the smoking material wherein the first cavity extends from the bottom end into the cylinder; a second cavity in the top end wherein the second cavity has a cylindrical shape and further wherein the second cavity extends from the top end into the cylinder to a position adjacent to the first cavity; a third cavity in the top end wherein the third cavity extends from the top end into the cylinder; a bottom cover that covers the first cavity wherein the bottom cover reversibly attaches and separates from the bottom end and further wherein the bottom cover has a circular shape; and a top cover that covers the second cavity and the third cavity wherein the top cover reversibly attaches and separates from the top end and further wherein the top cover has a circular shape.

In an embodiment, the storage receptacle has threads connected to the bottom cover and the bottom end wherein the threads enable the bottom cover to reversibly attach and separate from the bottom end.

In an embodiment, the storage receptacle has threads connected to the top cover and the top end wherein the threads enable the top cover to reversibly attach and separate from the top end.

In an embodiment, the bottom cover reversibly attaches and separates from the top cover.

In an embodiment, the storage receptacle has teeth that extend from the top cover and the bottom cover.

In an embodiment, the storage receptacle has a fourth cavity in the top end wherein the fourth cavity has a cylindrical shape and further wherein the fourth cavity extends from the top end into the cylinder.

In another embodiment of the present invention, a system for storing smoking material, a pipe and a lighter is provided. The pipe has a size and a shape. The lighter emits a flame and has a size and a shape. The system has a storage receptacle having a top end and a bottom end wherein the bottom end is located in a position opposite to the top end and further wherein the storage receptacle has a cylindrical shape; a first cavity in the bottom end which holds the smoking material wherein the first cavity extends from the bottom end into the cylinder; a second cavity in the top end wherein the second cavity extends from the top end into the storage receptacle and further wherein the second cavity has a size and a shape which are substantially the same as the size and the shape of the pipe; a third cavity in the top end wherein the third cavity extends from the top end into the storage receptacle and further wherein the second cavity has a size and a shape which are substantially the same as the size and the shape of the lighter; a fourth cavity in the top end and further wherein the fourth cavity extends from the top end into the cylinder; a bottom cover connected to the bottom end of the cylinder wherein the bottom cover moves from a first position to a second position to provide access to the first cavity and further wherein the bottom cover moves from the second position to the first position to cover the first cavity; and a top cover connected to the bottom end of the cylinder wherein the top cover moves from a first position to a second position to provide access to the second cavity, the third cavity and the fourth cavity and further wherein the top cover moves from the second position to the first position to cover the second cavity, the third cavity and the fourth cavity.

In an embodiment, the system has a cleaning pick having substantially the same dimensions as the fourth cavity.

In an embodiment, the system has an o-ring connected to one of the top end and the top cover wherein the o-ring is located between the top end and the top cover.

In an embodiment, the system has an o-ring connected to one of the bottom end and the bottom cover wherein the o-ring is located between the bottom end and the bottom cover.

In an embodiment, the top end, the bottom end, the top cover and the bottom cover have the same circular shape.

In an embodiment, the top cover has a diameter, the bottom cover has a diameter and the storage receptacle has a diameter and further wherein the diameter of the top cover, the diameter of the bottom cover and the diameter of the receptacle are approximately equal.

In an embodiment, the system has threads integral with at least one of the top cover and the top end wherein the threads enable the top cover to reversibly attach and separate from the top end.

In an embodiment, the system has threads integral with at least one of the bottom cover and the bottom end wherein the threads enable the bottom cover to reversibly attach and separate from the bottom end.

In an embodiment, the system has threads integral with at least one of the top cover and the top end wherein the threads enable the top cover to reversibly attach and separate from the top end.

In an embodiment, the fourth cavity has a cylindrical shape.

In another embodiment of the present invention, a method for using smoking material stored by a receptacle having a top end, a bottom end, a top cover and a bottom cover is provided. The top end is located in a position opposite to the bottom end. The bottom cover has first threads, the bottom end has second threads, the top cover has third threads and the bottom end has fourth threads. The method has the steps of removing the bottom cover from the bottom end by rotating the bottom cover to disengage the first threads from the second threads; removing the top cover from the top end by rotating the top cover to disengage the third threads from the fourth threads; placing the smoking material on one of the top cover and the bottom cover; connecting the bottom cover to the top cover by engaging the first threads to the third threads wherein the smoking material is located between the top cover and the bottom cover; rotating the top cover relative to the bottom cover to break the smoking material into smaller sizes; and disconnecting the bottom cover from the top cover by rotating the bottom cover relative to the top cover to disengage the first threads from the third threads.

In an embodiment, the method has the step of placing the smoking material into a cavity located in the bottom end to store the smoking material in the receptacle.

In an embodiment, the method has the step of storing a lighter, a cleaning pick and a pipe in the receptacle wherein the receptacle provides access to the lighter, the cleaning pick and the pipe and further wherein the lighter, the cleaning pick and the pipe are covered by the top cover.

In an embodiment, the method has the step of forming a seal between the bottom end and the bottom cover wherein the seal is formed by an o-ring located between the bottom end and the bottom cover.

It is, therefore, an advantage of the present invention to provide a storage receptacle for smoking material and a method for using the same.

Further, an advantage of the present invention is to provide a storage receptacle for smoking material that may store a lighter.

Another advantage of the present invention to provide a storage receptacle for smoking material that may store a cleaning pick for cleaning the pipe after use.

Yet another advantage of the present invention is to provide a storage receptacle for smoking material that may be lighter and/or more compact relative to prior art receptacles.

Still further, an advantage of the present invention is to provide a storage receptacle for smoking material that may open on opposite sides to store smoking equipment.

Yet another advantage of the present invention is to provide a storage receptacle for smoking material that may have a way for grinding, dividing and/or to separating the smoking material into smaller sizes.

Still another advantage of the present invention is to provide a storage receptacle for smoking material that may break the smoking material into smaller sizes using both cutting and crushing.

Yet another advantage of the present invention is to provide a storage receptacle for smoking material that may have a top cover and a bottom cover that may rotate relative to the storage receptacle to provide access to one or more cavities in the storage receptacle.

Further, an advantage of the present invention is to provide a storage receptacle for smoking material that may have threads which connect the top cover to the top end, the bottom cover to the bottom end, and/or the top cover to the bottom cover.

Another advantage of the present invention to provide a storage receptacle for smoking material that may have a cylindrical shape.

Yet another advantage of the present invention is to provide a storage receptacle for smoking material that may prevent and/or may hinder odor from exiting the storage receptacle and/or may prevent water and/or other liquids from entering the storage receptacle.

Moreover, another advantage of the present invention is to provide a storage receptacle for smoking material that may have reversibly removable ends which may connect to each other to form a grinder.

BRIEF DESCRIPTION OF THE DRAWINGS

FIG. 14D illustrates a top plan view of a receptacle with the top cover removed from the receptacle in an embodiment of the present invention.

DETAILED DESCRIPTION OF THE PREFERRED EMBODIMENTS

The present invention generally relates to a storage receptacle for smoking material, such as, for example, tobacco or the like, and a system and a method for using the same. More specifically, the present invention relates to a storage receptacle that may open on two opposite sides. A bottom end of the storage receptacle may have a first cavity which may store the smoking material. A top end of the storage receptacle may have a second cavity which may store a pipe, a third cavity which may store a lighter and a fourth cavity which may store a cleaning pick.

A top cover and a bottom cover may be removed from the top end and the bottom end of the receptacle, respectively. The top cover and the bottom cover may have teeth that may be used to grind, to divide and/or to separate the smoking material into smaller sizes. Threads may connect the top cover to the top end, the bottom cover to the bottom end, and/or the top cover to the bottom cover.

Figure 1:
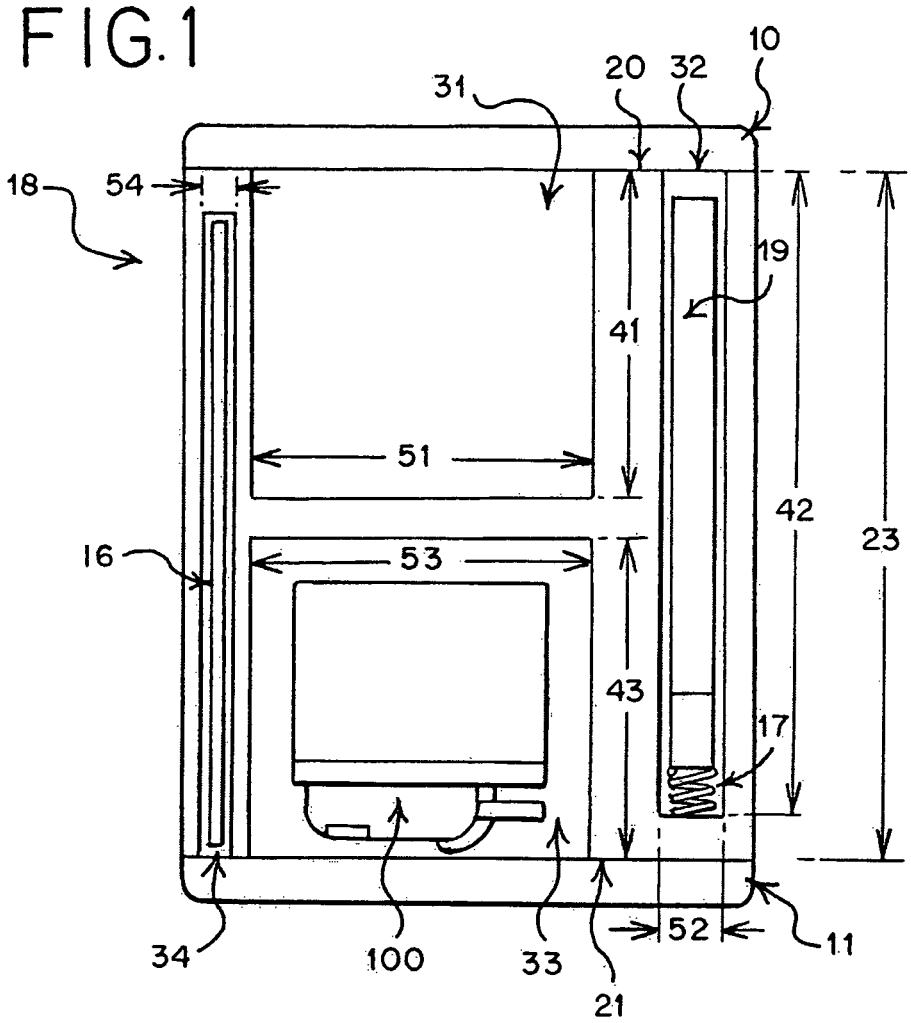
FIG. 1 illustrates a cross-sectional view of a receptacle in an embodiment of the present invention.
Figure 2A:
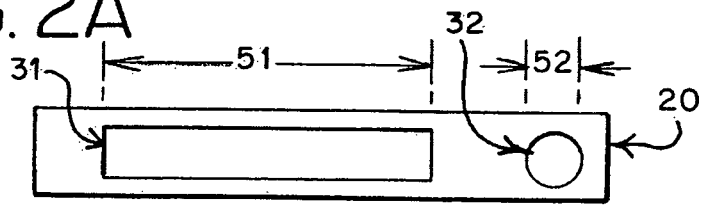
FIG. 2A illustrates a top plan view of a receptacle in an embodiment of the present invention.
Figure 2B:
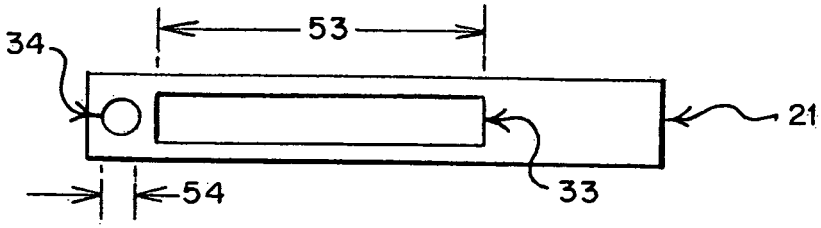
FIG. 2B illustrates a bottom plan view of a receptacle in an embodiment of the present invention.

Referring now to the drawings wherein like numerals refer to like parts, FIG. 1 illustrates a cross-sectional view of a receptacle 18, and FIGS. 2A and 2B illustrate a top view and a bottom view of the receptacle 18, respectively. The receptacle 18 may be a single solid piece and/or may be constructed of any material, such as, for example, plastic, wood, fiberglass and/or the like. For example, the receptacle 18 may be manufactured using injection molding, ultrasonic welding, hot plate welding and/or the like. The receptacle 18 may be any shape. In an embodiment, the receptacle 18 may be rectangular. The present invention is not limited to a specific shape of the receptacle 18.

The receptacle 18 may have a top end 20 and/or a bottom end 21 that may define a height 23 of the receptacle 18. As generally illustrated in FIGS. 2A and 2B, the top end 20 and/or the bottom end 21 may have a rectangular shape. The top end 20 and the bottom end 21 may have any shape. Referring again to FIGS. 1, 2A and 2B, a top cover 10 and/or a bottom cover 11 may connect to the receptacle 18 as described in more detail hereafter. The top cover 10 and the bottom cover 11 may have any shape. In an embodiment, the top cover 10 and/or the bottom cover 11 may have a rectangular shape substantially similar to the rectangular shape of the top end 20 and/or the bottom end 21 of the receptacle 18. The present invention is not limited to a specific shape of the top end 20 and the bottom end 21 of the receptacle 18, the top cover 10 or the bottom cover 11.

The top end 20 of the receptacle 18 may have a first cavity 31 and/or a second cavity 32. The top cover 10 may connect to the top end 20 of the receptacle 18 to limit and/or to prevent access to the first cavity 31 and/or the second cavity 32. The first cavity 31 may be used to store smoking material, such as, for example, tobacco, herbs, herbal blends and/or the like. The second cavity 32 may have a cylindrical shape and/or may store a pipe 19. The receptacle 18 may have a resilient element 17, such as, for example, a spring, connected to the second cavity 32. The resilient element 17 may be located at a position adjacent to the bottom end 21 of the receptacle 18. The resilient element 17 may enable a user to remove the pipe 19 from the receptacle 18 without inverting the receptacle 18 and/or spilling the smoking material. The user may insert the pipe 19 into the first cavity 31 to push the smoking material located in the first cavity 31 into the pipe 19. The present invention is not limited to a specific embodiment of the resilient element 17 or the pipe 19.

The first cavity 31 may have a depth 41, and/or the second cavity 32 may have a depth 42. The depth 41 of the first cavity 31 and the depth 42 of the second cavity 32 may be any depth. In an embodiment, the depth 41 of the first cavity 31 may be less than the depth 42 of the second cavity 32. The second cavity 32 may extend from the top end 20 of the receptacle 18 to a position adjacent to the bottom end 21 of the receptacle 18. The first cavity 31 may have a width 51, and/or the second cavity 32 may have a width 52. The width 52 of the second cavity 32 and the width 51 of the first cavity 31 may be any width. The width 52 of the second cavity 32 may be less than the width 51 of the first cavity 31. The present invention is not limited to a specific embodiment of the depth 41 and the width 51 of the first cavity 31 or the depth 42 and the width 52 of the second cavity 32.

In an embodiment, the bottom end 21 of the receptacle 18 may have a third cavity 33 and/or a fourth cavity 34. Connection of the bottom cover 11 to the bottom end 21 of the receptacle 18 may limit and/or may prevent access to the third cavity 33 and/or the fourth cavity 34. The third cavity 33 may store a lighter 100, matches or other like flame generating device that may emit a flame to burn the smoking material located in the pipe 19. For example, the lighter 100 may contain fluid (not shown) that may be used to generate the flame. The present invention is not limited to a specific embodiment of the lighter 100, and the lighter 100 may be any device capable of generating the flame as known to one having ordinary skill in the art.

In an embodiment, the lighter 100 may be fixed to the third cavity 33 and/or the receptacle 18 so that the lighter 100 may not be removed from the third cavity 33. For example, the lighter 100 may be fixed to the third cavity 33 by a screw, an adhesive and/or any means for attaching the lighter 100 to the third cavity 33 known to one having ordinary skill in the art. The fluid of the lighter 100 may be refilled using an orifice (not shown) in the lighter 100. The orifice may be accessed through the third cavity 33.

In another embodiment, the lighter 100 may not be fixed to the receptacle 18, and/or the lighter 100 may be reversibly removable from the receptacle 18. For example, the user may remove the bottom cover 11 to obtain access to the third cavity 33. Then, the user may remove the lighter 100 from the third cavity 33. After use of the lighter 100, the user may return the lighter 100 to the third cavity 33. Then, the user may re-attach the bottom cover 11 to the bottom end 21 of the receptacle 18 to hold the lighter 100 within the third cavity 33. Further, the lighter 100 may be replaced with a new lighter, such as, for example, if the fluid of the lighter 100 is insufficient for generating the flame.

The fourth cavity 34 may store a cleaning pick 16 for cleaning the pipe 19 after use of the pipe 19. For example, the pipe 19 and/or the cleaning pick 16 may have a cylindrical shape, and/or the cleaning pick 16 may be inserted into the pipe 19 to remove burned smoking material. The fourth cavity 34 may extend from the bottom end 21 of the receptacle 18 to a position adjacent to the top end 20 of the receptacle 18. The fourth cavity 34 may have a cylindrical shape that may accommodate storage of the cleaning pick 16. In an embodiment, the cleaning pick 16 may have an "L" shape that may prevent the cleaning pick 16 from falling into the fourth cavity 34, may assist the user in removing the cleaning pick 16 from the fourth cavity 34, and/or may assist the user in cleaning the pipe 19 with the cleaning pick 16. The present invention is not limited to a specific embodiment of the cleaning pick 16.

Figure 3:
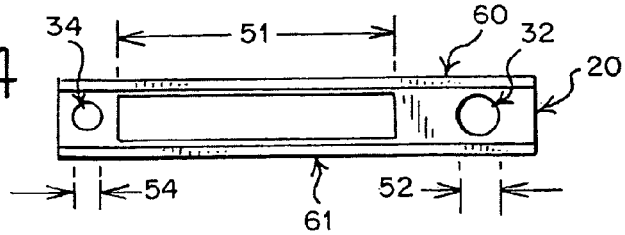
FIG. 3 illustrates a top plan view of a receptacle in an embodiment of the present invention.

In another embodiment, as generally illustrated in FIG. 3, the fourth cavity 34 may be located at the top end 20 of the receptacle 18. The fourth cavity 34 may extend from the top end 20 of the receptacle 18 to a position adjacent to the bottom end 21 of the receptacle 18.

Referring again to FIGS. 1, 2A and 2B, the third cavity 33 may have a depth 43, and/or the fourth cavity 43 may have a depth 44. The depth 43 of the third cavity 33 and the depth 44 of the fourth cavity 34 may be any depth. The depth 43 of the third cavity 33 may be less than the depth 44 of the fourth cavity 34. The depth 44 of the fourth cavity 43 may be approximately equal to the depth 42 of the second cavity 32. The third cavity 33 may have a width 53, and/or the fourth cavity 43 may have a width 54. The width 53 of the third cavity 33 and the width 54 of the fourth cavity 34 may be any width. In an embodiment, the width 54 of the fourth cavity 34 may be less than the width 51 of the first cavity 31, the width 52 of the second cavity 32 and/or the width 53 of the third cavity 33. In an embodiment, the width 53 of the third cavity 33 may be approximately equal to the width 51 of the first cavity 31. Alternatively, the width 53 of the third cavity 33 may be less than the width 51 of the first cavity 31. The present invention is not limited to a specific embodiment of the depth 43 and the width 53 of the third cavity 33 or the depth 44 and the width 54 of the fourth cavity 34.

Figure 4:
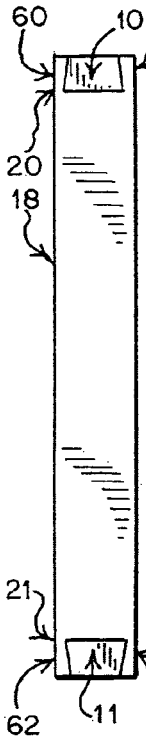
FIG. 4 illustrates a side plan view of a receptacle in an embodiment of the present invention.
Figure 5:
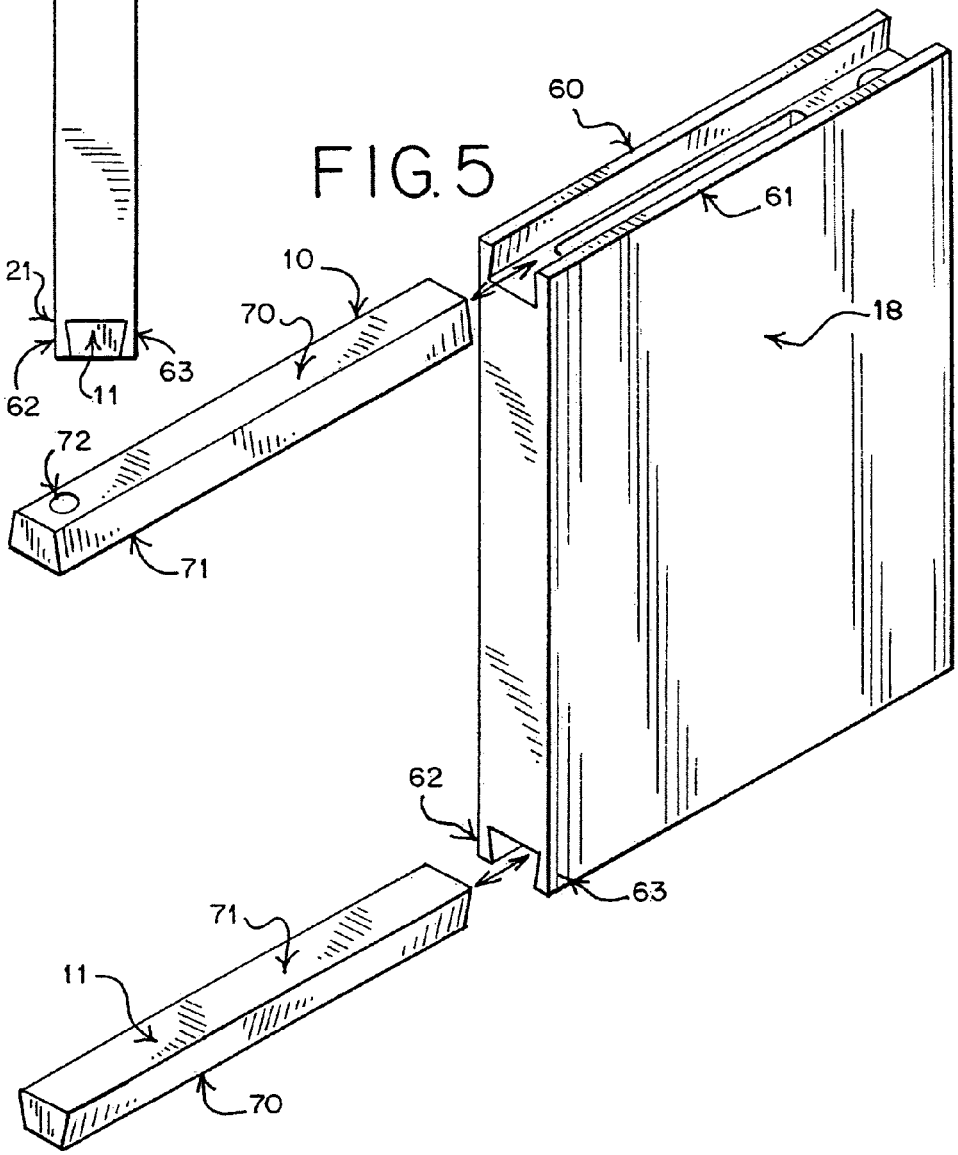
FIG. 5 illustrates a perspective view of a receptacle in an embodiment of the present invention.

As generally shown in FIGS. 4 and 5, in an embodiment, the top cover 10 and/or the bottom cover 11 may be removed from the top end 20 and/or the bottom end 21 of the receptacle 18, respectively, as discussed in more detail hereafter. Removal of the top cover 10 may provide access to the first cavity 31 and/or the second cavity 32. For example, the top cover 10 and/or the bottom cover 11 may be removed by sliding the top cover 10 and/or the bottom cover 11 horizontally relative to the receptacle 18. Re-attachment of the top cover 10 to the top end 20 of the receptacle 18 may limit and/or may prevent access to the first cavity 31 and/or the second cavity 32. For example, the top cover 10 and/or the bottom cover 11 may re-attach to the receptacle 18 by sliding the top cover 10 and/or the bottom cover 11 horizontally relative to the receptacle 18.

Removal of the bottom cover 11 may provide access to the third cavity 33 and/or the fourth cavity 34. Re-attachment of the bottom cover 11 to the bottom end 21 of the receptacle 18 may limit and/or may prevent access to the third cavity 33 and/or the fourth cavity 34.

In an embodiment, the fourth cavity 34 may be located on the top end 20 of the receptacle 18, as discussed previously. The removal of the top cover 10 may provide access to the fourth cavity 34. Further, the re-attachment of the top cover 10 to the top end 20 of the receptacle 18 may limit and/or may prevent access to the fourth cavity 34.

In an embodiment, the top cover 10 and/or the bottom cover 11 may have a taper as described in detail hereafter. The top cover 10 and/or the bottom cover 11 may have an outer face 70 and/or an inner face 71 located in a position opposite to the outer face 70. The outer face 70 may be narrower than the inner face 71 to provide the taper of the top cover 10 and/or the bottom cover 11. The top cover 10 and/or the bottom cover 11 may have an indentation 72 that extends into the outer face 70. The indentation 72 may assist the user in removing the top cover 10 and/or the bottom cover 11.

A first top wall 60 and/or a second top wall 61 may extend from the top end 20 of the receptacle 18. The first top wall 60 may be closer to the second top wall 61 at positions more proximate to the top end 20 of the receptacle 18 to provide a taper of the first top wall 60 and/or the second top wall 61. The taper of the first top wall 60 and/or the second top wall 61 may substantially match the taper of the top cover 10 to maintain connection of the top cover 10 to the receptacle 18. For example, unintentional removal of the top cover 10 may be prevented because the taper of the first top wall 60 and/or the second top wall 61 may substantially match the taper of the top cover 10.

A first bottom wall 62 and/or a second bottom wall 63 may extend from the bottom end 21 of the receptacle. The first bottom wall 62 may be closer to the second bottom wall 63 at positions more proximate to the bottom end 21 of the receptacle 18 to provide a taper of the first bottom wall 62 and/or the second bottom wall 63. The taper of the first bottom wall 62 and/or the second bottom wall 63 may substantially match the taper of the bottom cover 11 to maintain connection of the bottom cover 11 to the receptacle 18. For example, unintentional removal of the bottom cover 11 may be prevented because the taper of the first bottom wall 62 and/or the second bottom wall 63 may substantially match the taper of the bottom cover 11.

Figure 6B:
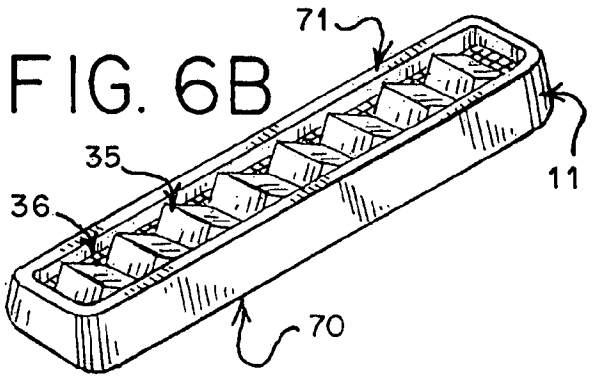
FIG. 6B illustrates a perspective view of a bottom cover of a receptacle in an embodiment of the present invention.
Figure 6A:
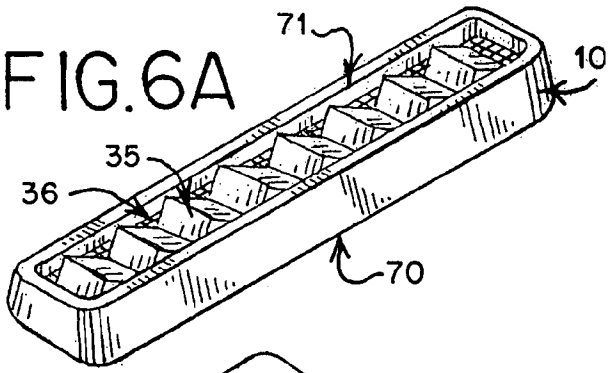
FIG. 6A illustrates a perspective view of a top cover of a receptacle in an embodiment of the present invention.
Figure 7:
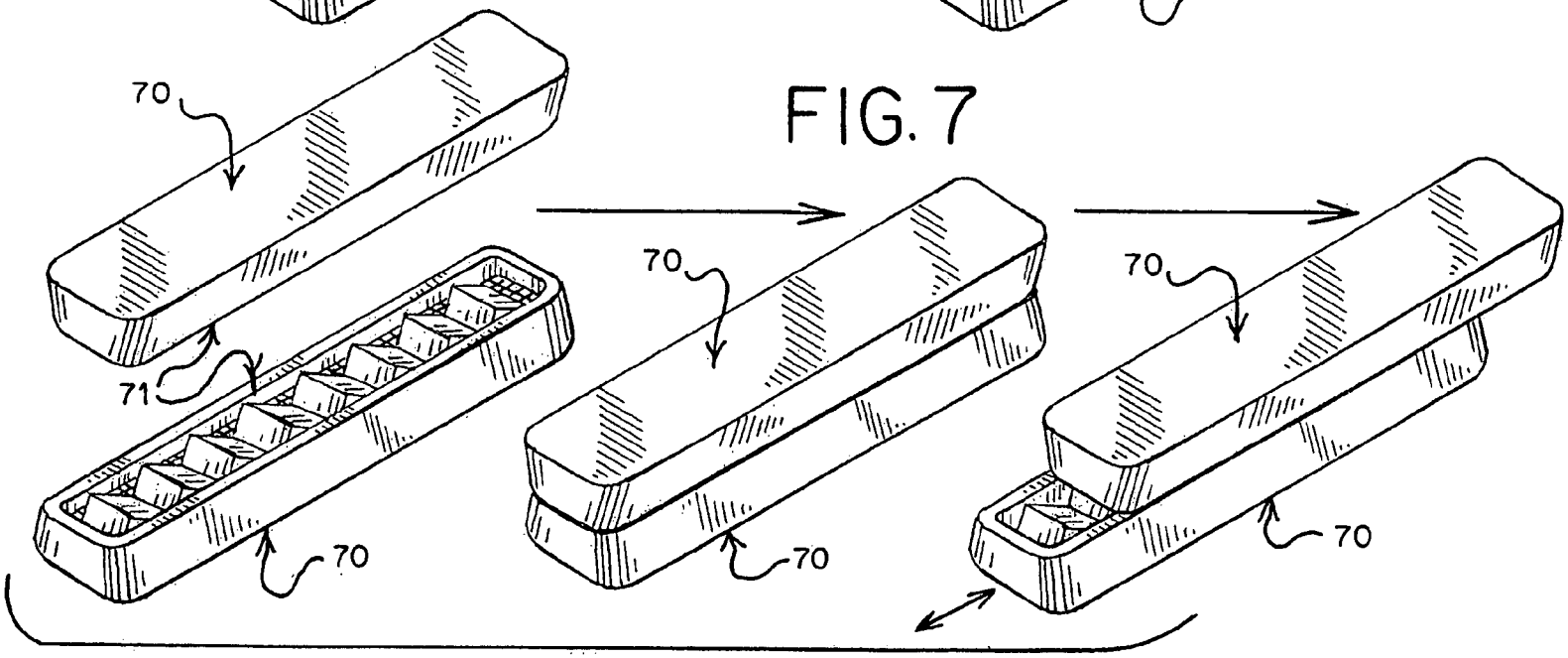
FIG. 7 illustrates a perspective view of a top cover and a bottom cover of a receptacle in an embodiment of the present invention.

As generally illustrated in FIGS. 6A, 6B and 7, the inner face 71 of the top cover 10 and/or the inner face 71 of the bottom cover 11 may have teeth 35. The teeth 35 may be, for example, indentations, extensions, protrusions, ridges and/or the like. In an embodiment, the teeth 35 may be rectangular protrusions. However, the teeth 35 may be any shape, and the present invention is not limited to a specific embodiment of the teeth 35.

The top cover 10 and/or the bottom cover 11 may have a screen 36 that may be located below the teeth 35. In an embodiment, the screen 36 may be a mesh screen. In an embodiment, the screen 36 may be reversibly removable from the top cover 10 and/or the bottom cover 11 such that the screen 36 may be removed and may be subsequently re-attached. The present invention is not limited to a specific embodiment of the teeth 35 or the screen 36.

FIG. 7 generally illustrates use of the top cover 10 and/or the bottom cover 11 to grind, to divide and/or to separate the smoking material into smaller sizes. The smoking material may be placed on the inner face 71 of the top cover 10 or the bottom cover 11. Then, the inner face 71 of the top cover 10 may be pressed against the inner face 71 of the bottom cover 11 so that the smoking material is located between the teeth 35 of the top cover 10 and the teeth 35 of the bottom cover 11. Then, the user may slide the top cover 10 and/or the bottom cover 11 horizontally to separate the smoking material into smaller sizes. The smoking material having the smaller sizes may be placed in the first cavity 12 for storage, transportation and/or use in the pipe 19. For example, the user may remove the screen 36 from the top cover 10 and/or the bottom cover 11 to transport the smoking material having the smaller sizes to the first cavity 12.

Figure 8:
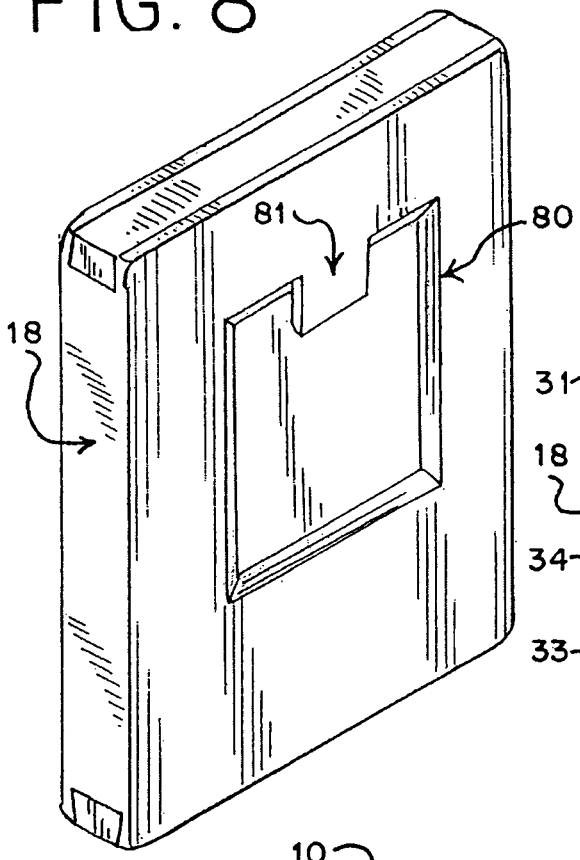
FIG. 8 illustrates a perspective view of a receptacle in an embodiment of the present invention.

FIG. 8 generally illustrates an embodiment of the present invention wherein a bottle opener 80 may be attached to the receptacle 18. For example, the user may have a bottle (not shown) that contains a beverage so that the user may consume the beverage before, during and/or after using the pipe 19. The bottle may have a bottle cap that may require removal from the bottle before the beverage may be consumed.

The bottle opener 80 may have an edge 81 that may be inserted between a bottle and a bottle cap to remove the bottle cap from the bottle. In an embodiment, the bottle opener 80 may be located adjacent to the top end 20 or the bottom end 21 of the receptacle. For example, the bottle opener 80 may be located below the top cover 10 or the bottom cover 11. In an embodiment, the bottle opener 80 may be accessed if the top cover 10 or the bottom cover 11 are removed from the receptacle 18. The present invention is not limited to a specific embodiment of the bottle opener 80 or a specific location of the bottle opener 80, and the bottle opener 50 may be any bottle opener known to one having ordinary skill in the art.

Figure 9:
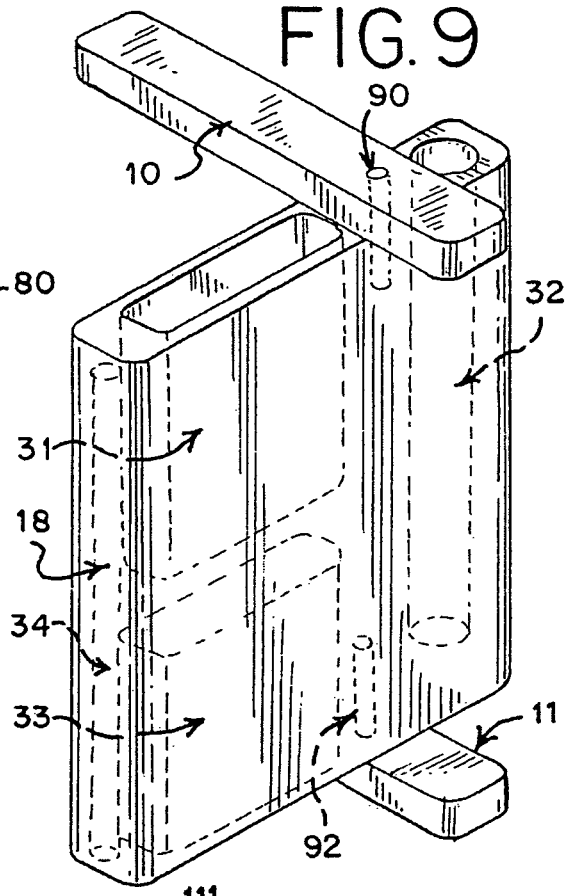
FIG. 9 illustrates a perspective view of a receptacle in an embodiment of the present invention.

FIG. 9 generally illustrates that the top cover 10 and/or the bottom cover 11 may rotate relative to the receptacle 18. If the top cover 10 may rotate relative to the receptacle 18, the top end 20 of the receptacle 18 may not have the first top wall 60 and/or the second top wall 61. If the bottom cover 11 may rotate relative to the receptacle 18, the bottom end 21 of the receptacle 18 may not have the first bottom wall 62 and/or the second bottom wall 63. The top cover 10 may be connected to the top end 20 of the receptacle 18 by a first rod 90 that may be inserted into the outer face 70 of the top cover 10. The first rod 90 may extend through the top cover 10 to the inner face 71 of the top cover 10. The first rod 90 may extend into the top end 20 of the receptacle 18 to connect the top cover 10 to the receptacle 18. The top cover 10 may rotate around the first rod 90.

The top cover 10 may limit and/or may prevent access to the first cavity 31 and/or the second cavity 32 if the top cover 10 is located in a first position. For example, if the top cover 10 is located in the first position, the top cover may be approximately parallel to the receptacle 18. Rotation of the top cover 10 from the first position to a second position that is substantially perpendicular to the first position may provide access to the first cavity 31 and/or the second cavity 32. For example, if the top cover 10 is located in the second position, the top cover 10 may be approximately perpendicular to the receptacle 18. The access to the first cavity 31 and/or the second cavity 32 may be used to obtain and/or to use the smoking material and/or the pipe 19. Rotation of the top cover 10 from the second position to the first position may limit and/or may prevent access to the first cavity 31 and/or the second cavity 32.

In an embodiment, the fourth cavity 34 may be located at the top end 20 of the receptacle 18, as discussed previously. Rotation of the top cover 10 from the first position to the second position may provide access to the fourth cavity 34. Rotation of the top cover 10 from the second position to the first position may limit and/or may prevent access to the fourth cavity 34.

The bottom cover 11 may be connected to the bottom end 21 of the receptacle 18 by a second rod 91 inserted into the outer face 70 of the bottom cover 11. The second rod 91 may extend through the bottom cover 11 to the inner face 71 of the bottom cover 11. The second rod 91 may extend into the bottom end 21 of the receptacle 18 to connect the bottom cover 11 to the receptacle 18. The bottom cover 11 may rotate around the second rod 91.

The bottom cover 11 may prevent access to the third cavity 33 and/or the fourth cavity 34 if the bottom cover 11 is located in a first position. For example, if the bottom cover 11 is located in the first position, the bottom cover 11 may be approximately parallel to the receptacle 18. Rotation of the bottom cover 11 from the first position to a second position that is substantially perpendicular to the first position may provide access to the third cavity 33 and/or the fourth cavity 34. For example, if the bottom cover 11 is located in the second position, the bottom cover 11 may be approximately perpendicular to the receptacle 18. The access to the third cavity 33 and/or the fourth cavity 34 may be used to obtain and/or use the lighter 100 and/or the cleaning pick 16. Rotation of the top cover 10 from the second position to the first position may limit and/or may prevent access to the third cavity 33 and/or the fourth cavity 34.

In an embodiment, the first rod 90 and/or the second rod 91 may be removed from the receptacle 18 to enable removal of the top cover 10 and/or the bottom cover 11, respectively. For example, the first rod 90 and the second rod 91 may be removed from the receptacle 18 to enable use of the top cover 10 and the bottom cover 11 to grind, to divide and/or to separate the smoking material into the smaller sizes.

The present invention is not limited to a specific embodiment of the top cover 10 and the bottom cover 11. For example, both the top cover 10 and the bottom cover 11 may be removed from the receptacle 18 by sliding horizontally relative to the receptacle 18; the top cover 10 may be removed from the receptacle 18 by sliding horizontally relative to the receptacle, and the bottom cover 11 may rotate relative to the receptacle 18; the bottom cover 11 may be removed from the receptacle 18 by sliding horizontally relative to the receptacle, and the top cover 10 may rotate relative to the receptacle 18; or both the top cover 10 and the bottom cover 11 may rotate relative to the receptacle 18.

Figure 10:
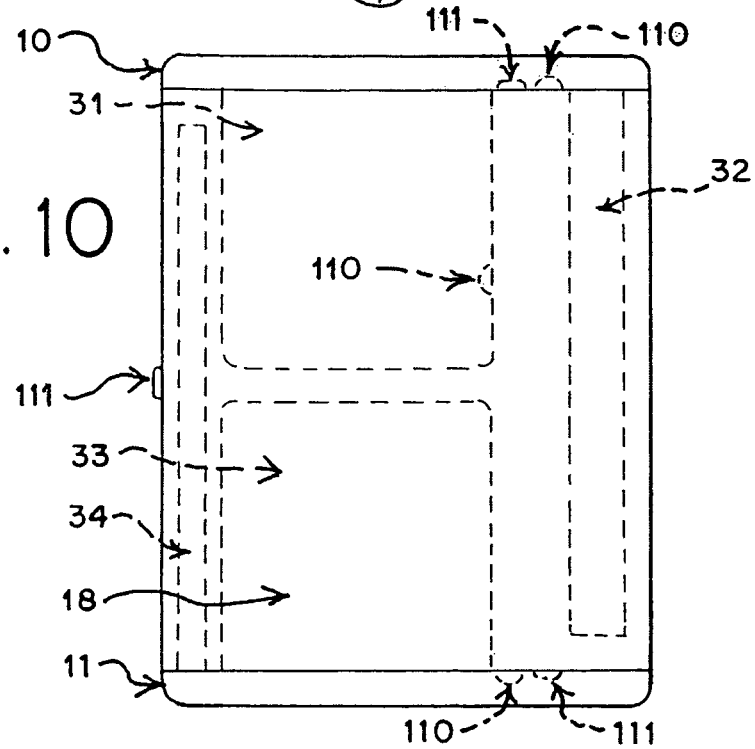
FIG. 10 illustrates a cross-sectional view of a receptacle in an embodiment of the present invention.
Figure 11:
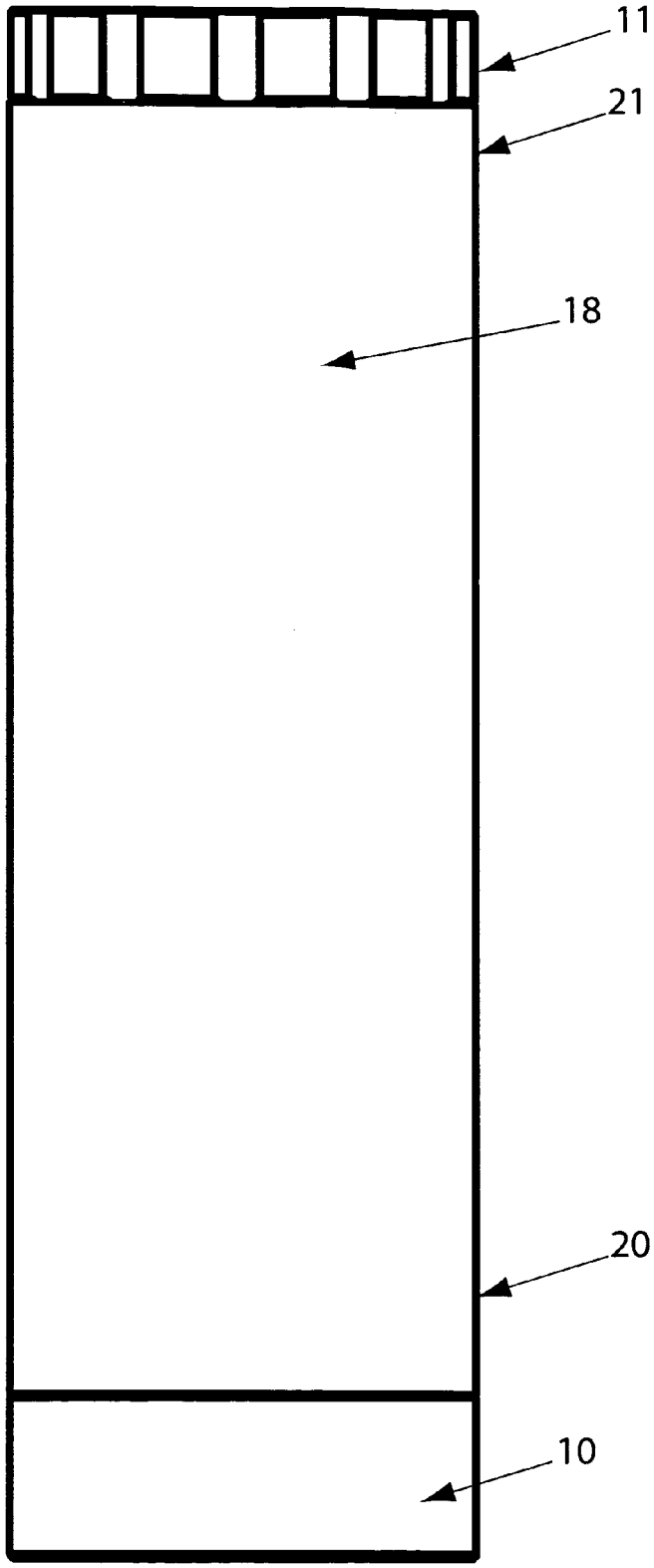
FIG. 11 illustrates a side plan view of a receptacle in an embodiment of the present invention.
Figure 12:
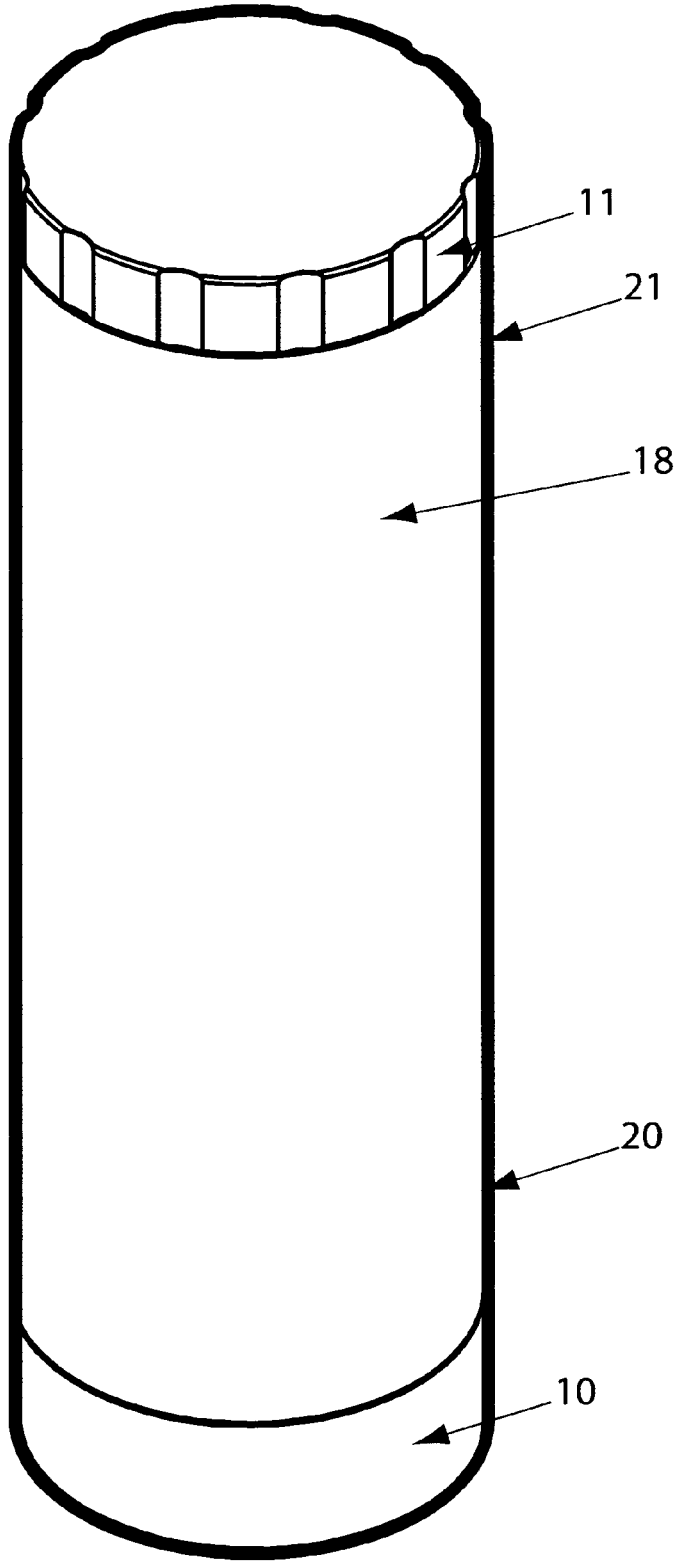
FIGS. 12 and 13 illustrate perspective views of a receptacle in an embodiment of the present invention.
Figure 13:
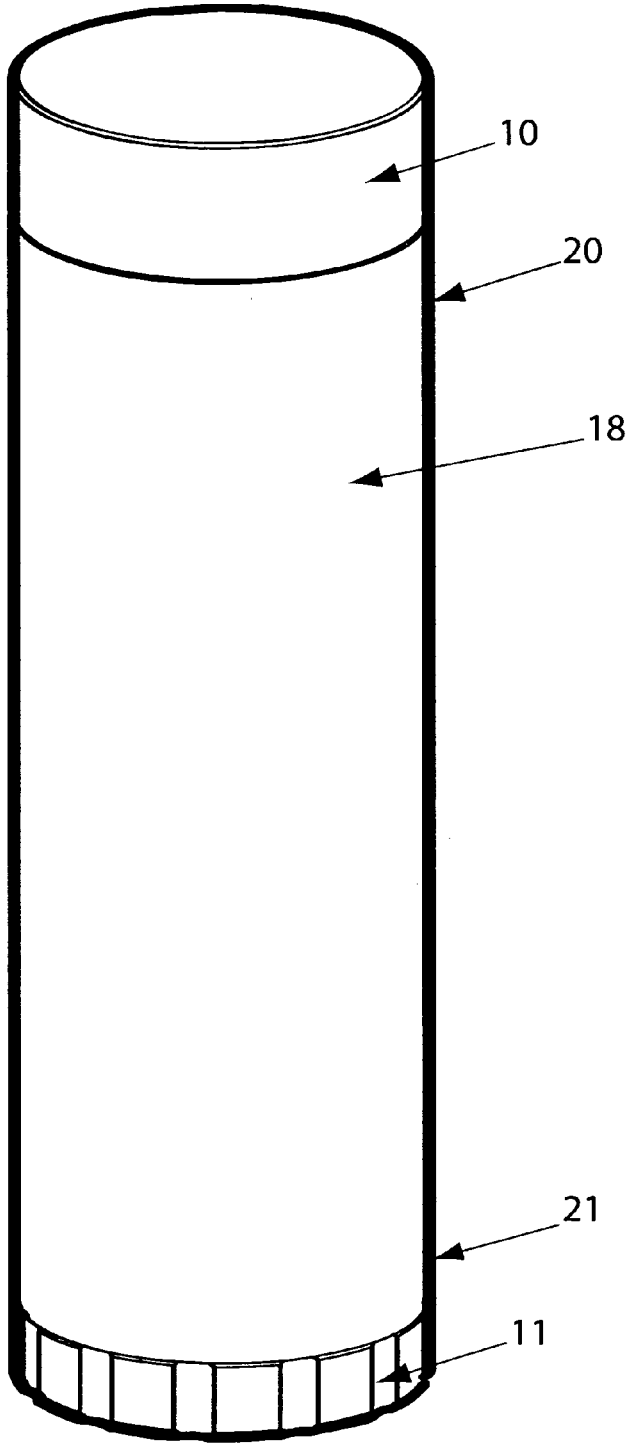
Figure 19:
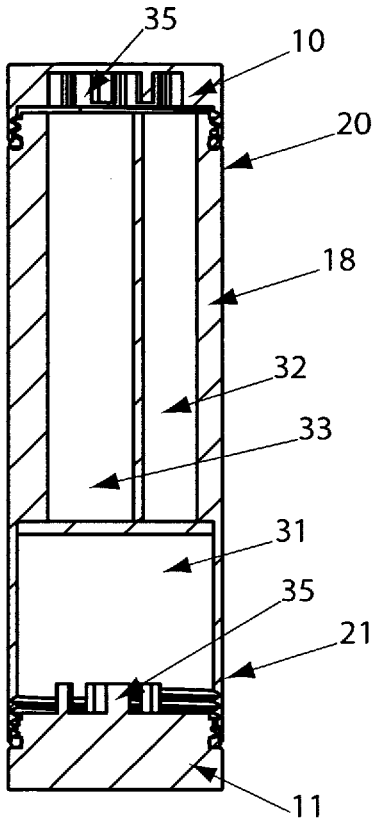
FIG. 19 illustrates a cross-sectional view of receptacle in an embodiment of the present invention.

As generally illustrated in FIG. 10, in an embodiment of the present invention, a light 110 may be connected to the receptacle 18. For example, the light 110 may be located in the first cavity 31. As a further example, the light 110 may be located on an exterior of the receptacle 18. As yet another example, the light 110 may be located on the top end 20 and/or the bottom end 21 of the receptacle 18, and/or the light 110 may be accessed by removing and/or rotating the top cover 10 and/or the bottom cover 11, respectively.

The receptacle 18 may have a power button 111 that may activate and/or may deactivate the light 110. For example, the power button 111 may control power to the light 110. If the user presses the power button 111, the light 110 may be activated. If the user presses the power button 111 again, the light 110 may be deactivated. For example, the power button 111 may be located on the exterior of the receptacle 18. As a further example, the power button 111 may be located on the top end 20 and/or the bottom end 21 of the receptacle 18, and/or the power button 111 may be accessed by removing and/or rotating the top cover 10 and/or the bottom cover 11, respectively. In an embodiment, the light 110 may be activated and/or deactivated automatically. For example, the light 110 may be activated if the top cover 10 and/or the bottom cover 11 are removed and/or rotated to a position that is perpendicular to the receptacle 18. Then, the light 110 may be deactivated if the top cover 10 and/or the bottom cover are re-attached and/or rotated to a position that is parallel to the receptacle 18. The present invention is not limited to a specific location or a specific embodiment of the power button 111 or the light 110.

The receptacle 18 may have a battery (not shown) that may provide the power to the light 110. For example, if the user presses the power button 111, the light 110 may receive the power from the battery and the light 110 may be activated. If the user presses the power button 111 again, the light 110 may cease receiving the power from the battery and the light 110 may be deactivated. In an embodiment, the light 110 may receive and/or cease receiving the power automatically. For example, the light 110 may receive the power if the top cover 10 and/or the bottom cover 11 are removed and/or rotated to a position that is perpendicular to the receptacle 18. Then, the light 110 may cease receiving the power if the top cover 10 and/or the bottom cover 11 are re-attached and/or rotated to a position that is parallel to the receptacle 18.

FIGS. 11-24 generally illustrate other embodiments of the receptacle 18. The receptacle 18 may have a cylindrical shape, and/or the top end 20 and/or the bottom end 21 may have a circular shape. The top cover 10 and the bottom cover 11 may have a circular shape substantially similar to the circular shape of the top end 20 and/or the bottom end 21 of the receptacle 18, respectively.

Figure 18:
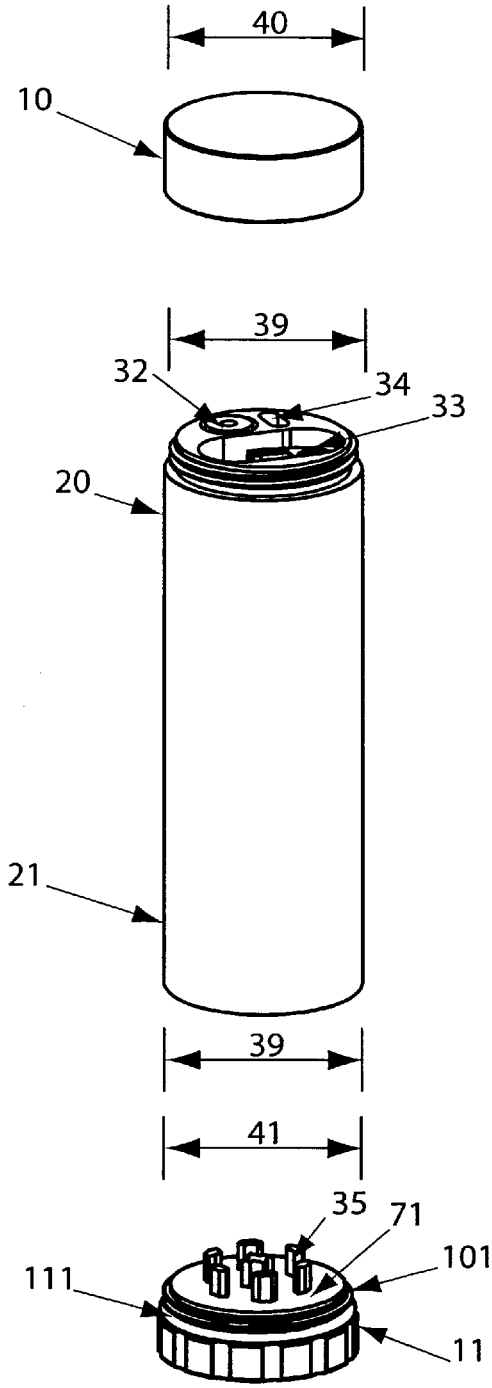
Figure 20:
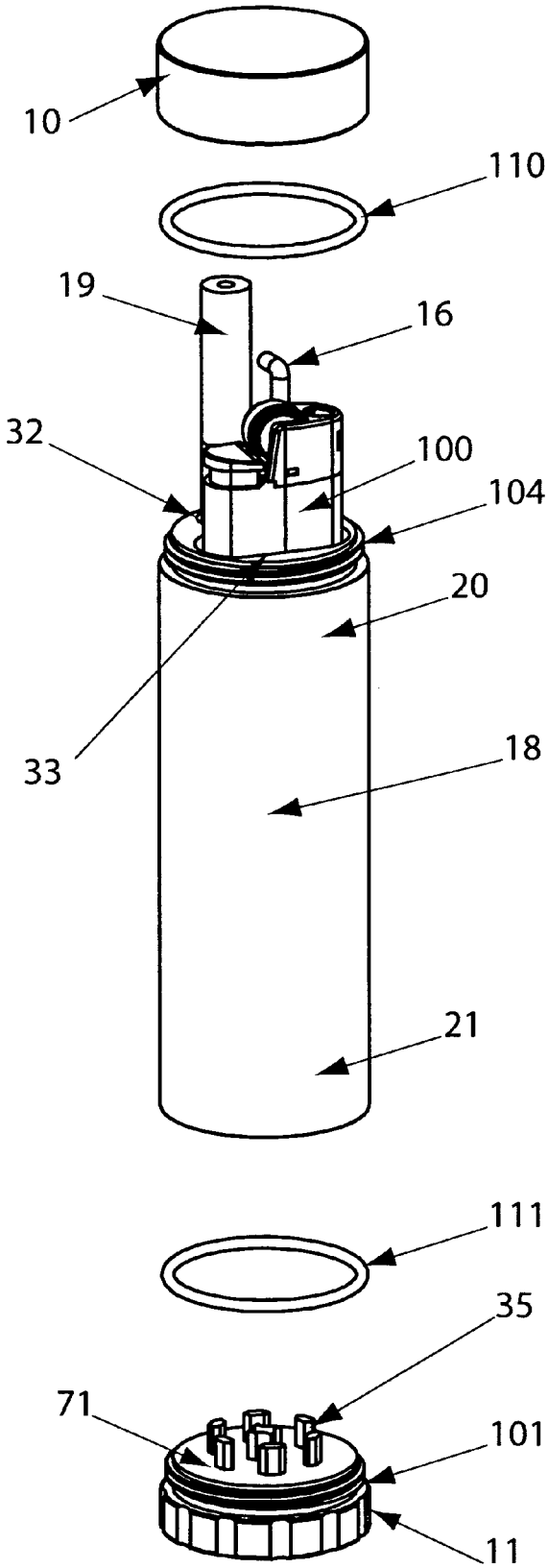
FIG. 20 illustrates a perspective exploded view of a receptacle in an embodiment of the present invention.
Figure 21:
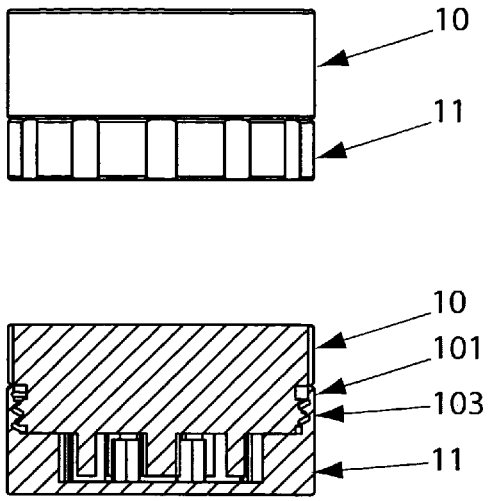
FIG. 21 illustrates a side plan view of the top cover connected to the bottom cover in an embodiment of the present invention.
Figure 22:
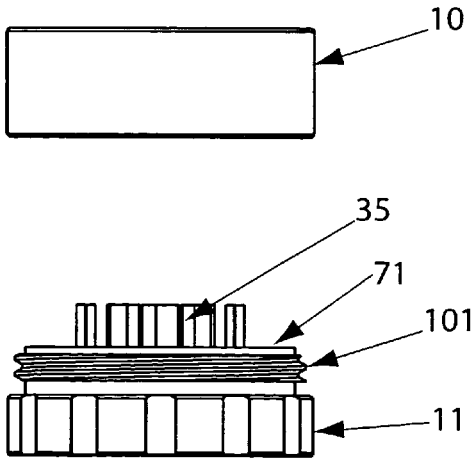
FIG. 22 illustrates a side plan view of the top cover and the bottom cover disconnected in an embodiment of the present invention.
Figure 23:
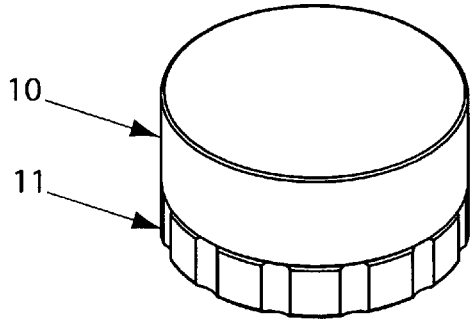
FIG. 23 illustrates a side plan view of the top cover connected to the bottom cover in an embodiment of the present invention.
Figure 24:
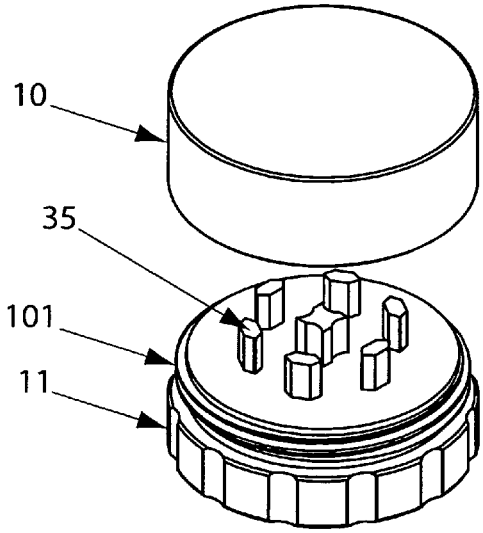
FIG. 24 illustrates a side plan view of the top cover and the bottom cover disconnected in an embodiment of the present invention.

For example, as shown in FIGS. 14A, 14B, 14C, 14D, 14E and 18, the receptacle 18 may have a diameter 39, the top cover 10 may have a diameter 40, and/or the bottom cover 11 may have a diameter 41. In an embodiment, the diameter 39 of the receptacle, the diameter 40 of the top cover 10, and/or the diameter 41 of the bottom cover 11 may be approximately equal. As shown in FIG. 18, in an embodiment, the diameter 39 of the receptacle 18 may be the same from the top end 20 to the bottom end 21. The top cover 10 and/or the bottom cover 11 may connect to the receptacle 18 as described in more detail hereafter.

The receptacle 18, the top cover 10 and/or the bottom cover 11 may be made from any material. In an embodiment, the receptacle 18, the top cover 10 and/or the bottom cover 11 may be aluminum. In another embodiment, the receptacle 18, the top cover 10 and/or the bottom cover 11 may be plastic. In an embodiment, the receptacle 18, the top cover 10 and/or the bottom cover 11 may have an anodized finish. The receptacle 18, the top cover 10 and/or the bottom cover 11 may be made using any manufacturing method known to one having ordinary skill in the art. In an embodiment, the receptacle 18, the top cover 10 and/or the bottom cover 11 may be manufactured using an extrusion process.

Figure 14A:
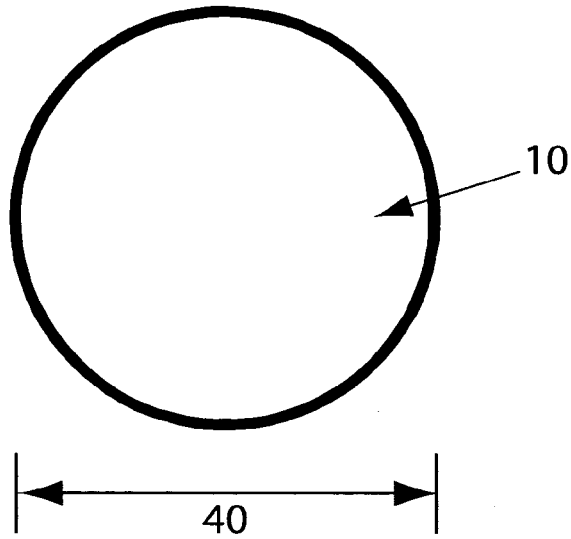
FIG. 14A illustrates a top plan view of a receptacle with the top cover connected to the receptacle in an embodiment of the present invention.
Figure 14B:
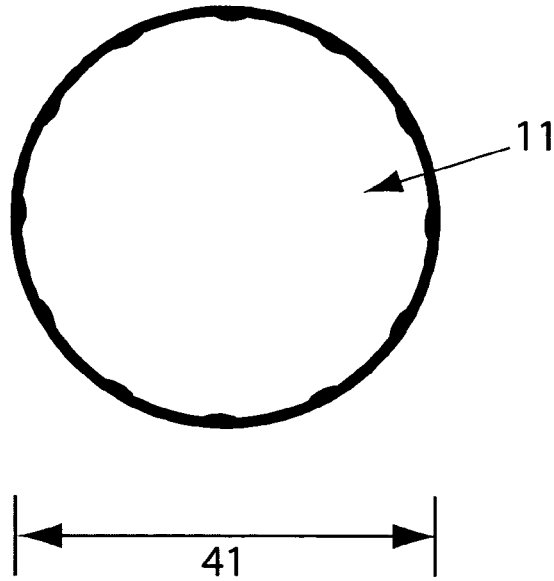
FIG. 14B illustrates a bottom plan view of a receptacle with the bottom cover connected to the receptacle in an embodiment of the present invention.
Figure 14C:
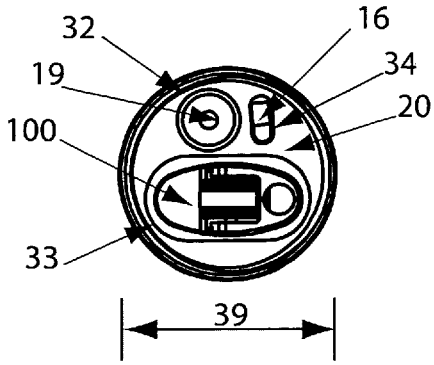
FIG. 14C illustrates a top plan view of a receptacle with the top cover removed from the receptacle and smoking equipment stored by the receptacle in an embodiment of the present invention.
Figure 14D:
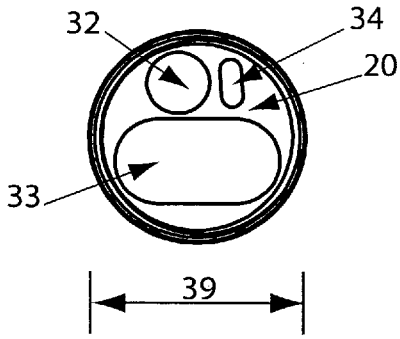
FIG. 14D illustrates a top plan view of a receptacle with the top cover removed from the receptacle without the smoking equipment stored by the receptacle in an embodiment of the present invention.
Figure 14E:
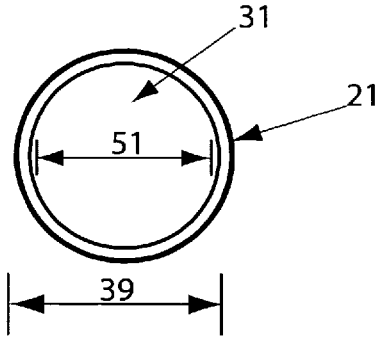
Figure 15:
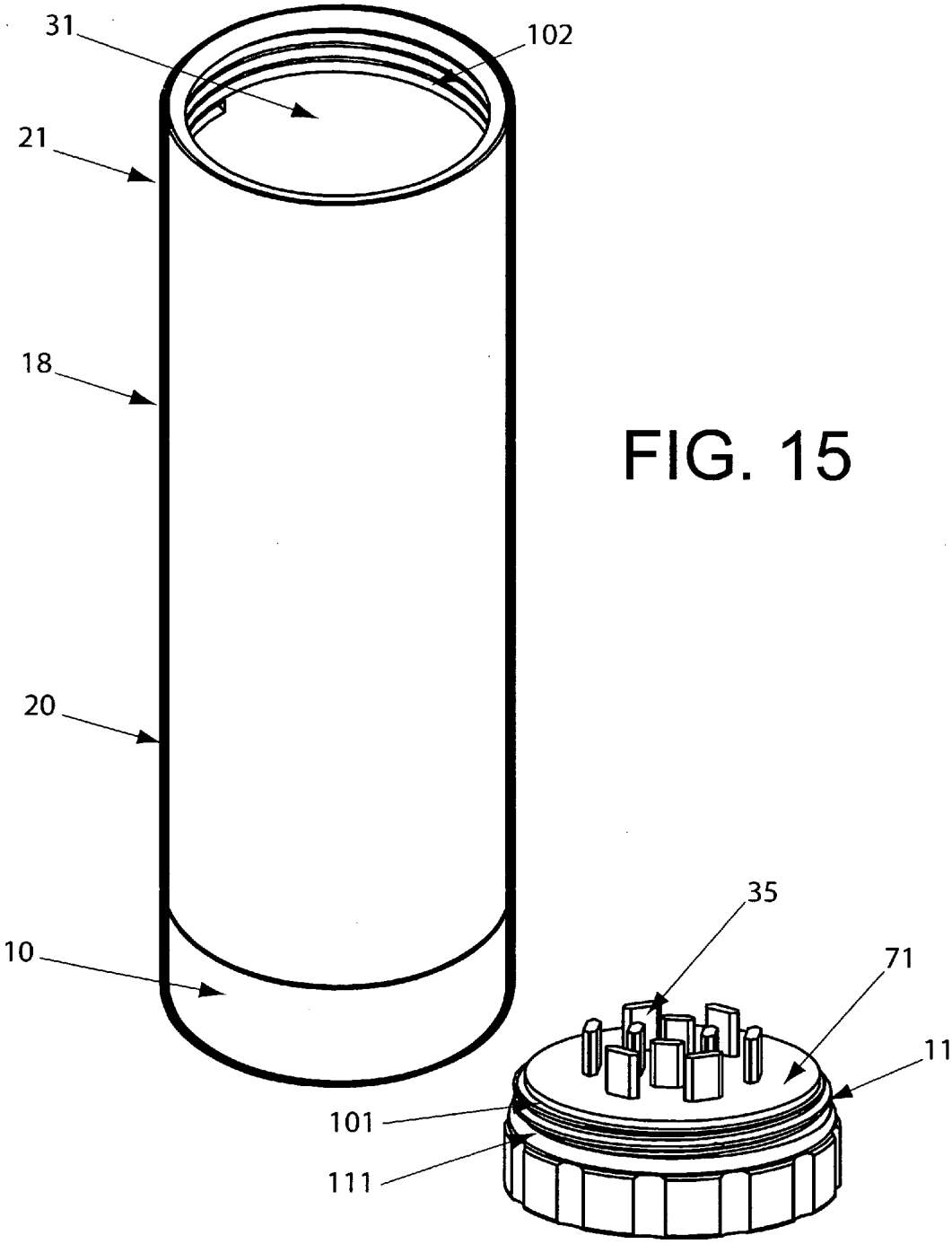
FIGS. 15 and 16 illustrate perspective views of a receptacle in an embodiment of the present invention.
Figure 16:
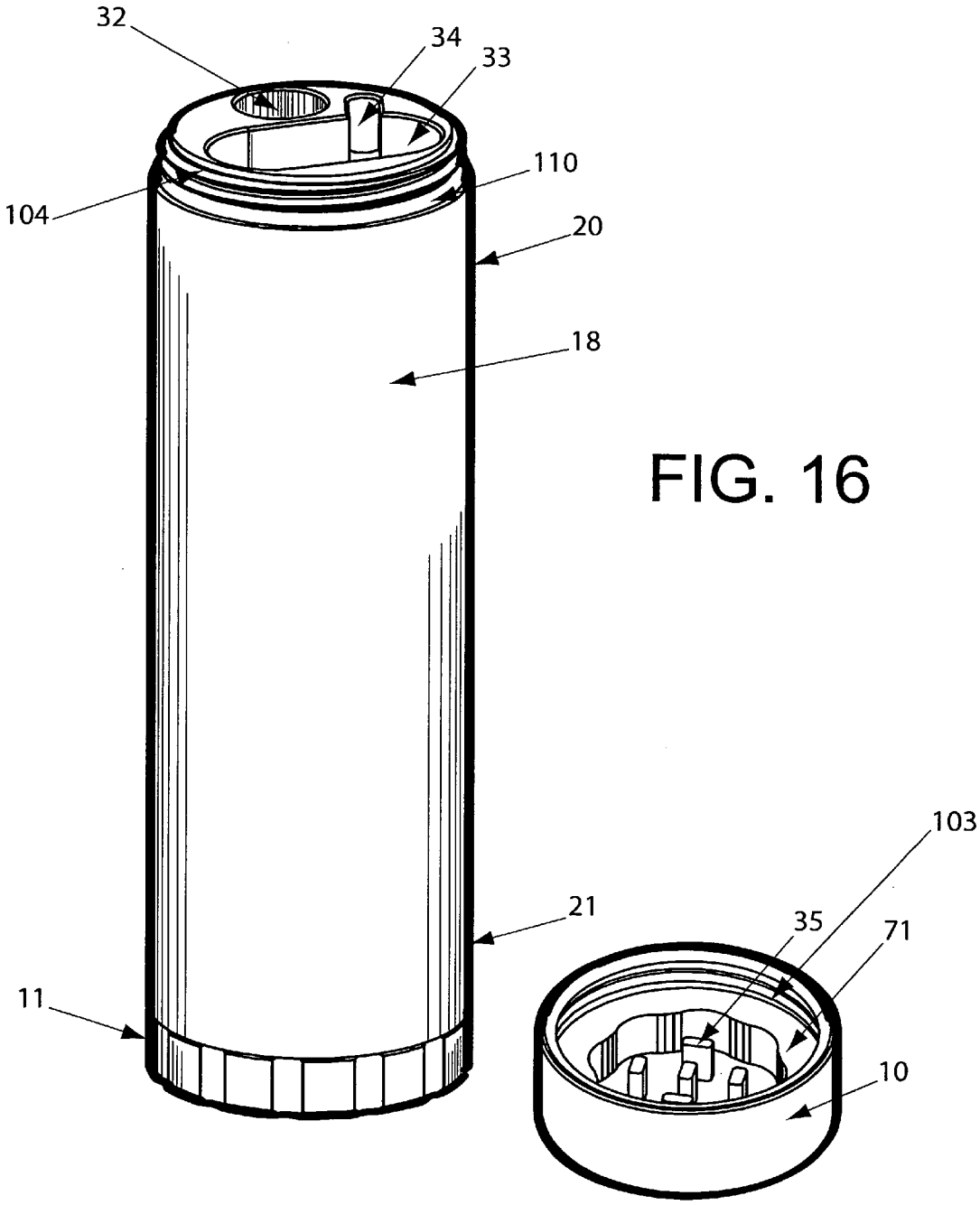
Figure 17:
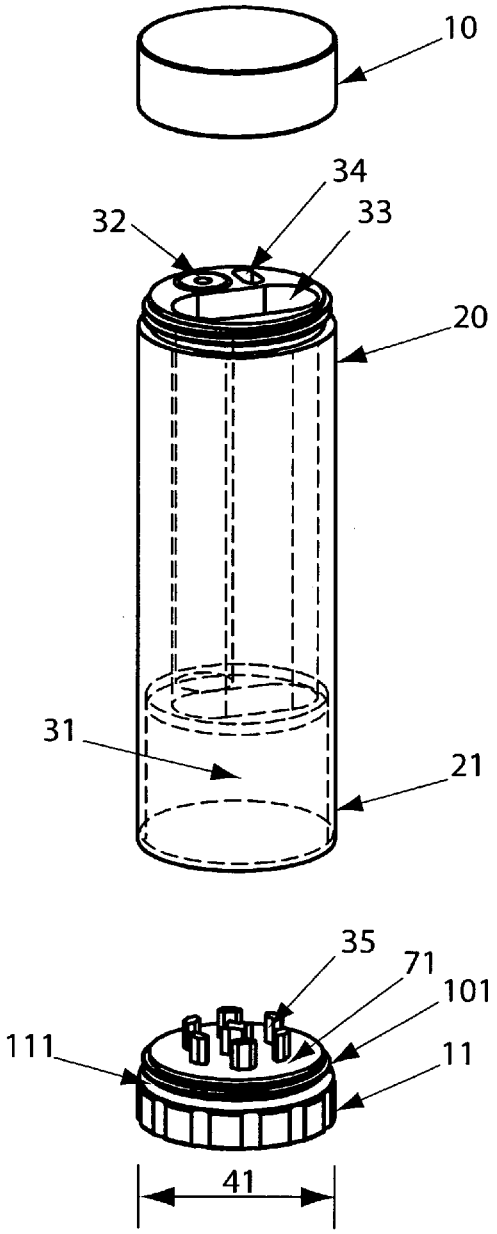
FIGS. 17 and 18 illustrate perspective exploded views of a receptacle in an embodiment of the present invention.

Referring again to FIGS. 11-20, the bottom end 21 of the receptacle 18 may have the first cavity 31 which may be used to store smoking material, such as, for example, tobacco, herbs, herbal blends and/or the like. As shown in FIG. 14E, the first cavity 31 may have a diameter 51, and, in an embodiment, the diameter 51 of the first cavity 31 may be approximately equal to the diameter 39 of the receptacle 18. AS shown in FIGS. 11-20, the bottom cover 11 may connect to the bottom end 21 of the receptacle 18 to limit and/or to prevent access to the first cavity 31. The bottom cover 11 may disconnect from the bottom end 21 of the receptacle 18 to provide access to the first cavity 31.

For example, in an embodiment, the bottom cover 11 may have first threads 101, and/or the bottom end 21 may have second threads 102. The first threads 101 and/or the second threads 102 may be directly connected to the bottom cover 11 and/or the bottom end 21, respectively. For example, the first threads 101 and/or the second threads 102 may be integral with the bottom cover 11 and/or the bottom end 21, respectively.

The first threads 101 may connect to the second threads 102 to connect the bottom cover 11 to the bottom end 21 of the receptacle 18. The first threads 101 may disconnect from the second threads 102 to disconnect the bottom cover 11 from the bottom end 21 of the receptacle 18. For example, rotation of the bottom cover 11 in a first direction relative to the bottom end 21 of the receptacle 18 may disconnect the first threads 101 from the second threads 102 to disconnect the bottom cover 11 from the bottom end 21 of the receptacle 18. The bottom cover 11 may be rotated relative to the bottom end 21 of the receptacle 18 in a second direction opposite to the first direction. Rotation of the bottom cover 11 in the second direction may re-connect the first threads 101 to the second threads 102 to re-connect the bottom cover 11 to the bottom end 21 of the receptacle 18.

The first threads 101 and/or the second threads 102 may be helical. The first threads 101 may be angled relative to the bottom cover 11 at approximately the same angle that the second threads 102 are angled relative to the bottom end 21 of the receptacle 18. In an embodiment, the first threads 101 may be male threads, and the second threads 102 may be female threads. For example, the first threads 101 may extend in a direction generally outward from the bottom cover 11, and/or the second threads 102 may extend in a direction generally inward into the bottom end 21 of the receptacle 18. The first threads 101 may insert into the second threads 102 to connect the first threads 101 to the second threads 102.

In another embodiment, the first threads 101 may be female threads, and the second threads 102 may be male threads. For example, the first threads 101 may extend in a direction generally inward into the bottom cover 11, and/or the second threads 102 may extend in a direction generally outward from the bottom end 21 of the receptacle 18. The second threads 102 may insert into the first threads 101 to connect the first threads 101 to the second threads 102.

The bottom cover 11 may have a bottom o-ring 111. The bottom o-ring 111 may be a loop which may have a disc-shaped cross-section. The bottom o-ring 111 may be made from any material. In an embodiment, the bottom o-ring 111 may be an elastomer, such as, for example, silicone. The first threads 101 may be located between the bottom o-ring 111 and the inner face 71 of the bottom cover 11. The bottom o-ring 111 may be compressed if the bottom cover 11 connects to the bottom end 21 of the receptacle 18, and/or the bottom o-ring 111 may create a seal between the bottom cover 11 and the bottom end 21 of the receptacle 18. The bottom o-ring 111 may prevent and/or may hinder odor from exiting the receptacle 18 and/or may prevent water and/or other liquids from entering the receptacle 18.

The top end 20 of the receptacle 18 may have the second cavity 32 which may store the pipe 19. In an embodiment, the second cavity 32 may have approximately the same dimensions, such as, for example, the same size and/or the same shape, as the pipe 19. The second cavity 32 may have a cylindrical shape. The top cover 10 may connect to the top end 20 of the receptacle 18 to limit and/or to prevent access to the second cavity 32. The second cavity 32 may extend from the top end 20 of the receptacle 18 to a position adjacent to the first cavity 31. As previously set forth, the receptacle 18 may have a resilient element 17, such as, for example, a spring, connected to the second cavity 32. The resilient element 17 may be located at a position adjacent to the first cavity 31, and/or the resilient element 17 may enable a user to remove the pipe 19 from the receptacle 18 without inverting the receptacle 18 and/or spilling the smoking material. The user may insert the pipe 19 into the first cavity 31 to push the smoking material located in the first cavity 31 into the pipe 19. The pipe 19 may be made from any material. In an embodiment, the pipe 19 may be aluminum. In another embodiment, the pipe 19 may be quartz glass.

The top end 20 of the receptacle 18 may have the third cavity 33 which may store the lighter 100. The lighter 100 may emit a flame which may be used to burn the smoking material located in the pipe 19. For example, the lighter 100 may contain fluid (not shown) that may be used to generate the flame. The third cavity 32 may have a size and/or a shape substantially similar to a size and/or a shape of the lighter 100. The third cavity 32 may extend from the top end 20 of the receptacle 18 to a position adjacent to the first cavity 31.

The top end 20 of the receptacle 18 may have the fourth cavity 34 which may store the cleaning pick 16. The cleaning pick 16 may be used for cleaning the pipe 19 after use of the pipe 19. For example, the pipe 19 and/or the cleaning pick 16 may have a cylindrical shape, and/or the cleaning pick 16 may be inserted into the pipe 19 to remove burned smoking material. The cleaning pick 16 may be made from any material. In an embodiment, the cleaning pick 16 may be stainless steel. The fourth cavity 34 may extend from the top end 20 of the receptacle 18 to a position adjacent to the first cavity 31. The fourth cavity 34 may have a cylindrical shape that may accommodate storage of the cleaning pick 16. The fourth cavity 34 may have a size and/or a shape substantially similar to a size and/or a shape of the cleaning pick 16. In an embodiment, the cleaning pick 16 may have an "L" shape that may prevent the cleaning pick 16 from falling into the fourth cavity 34, may assist the user in removing the cleaning pick 16 from the fourth cavity 34, and/or may assist the user in cleaning the pipe 19 with the cleaning pick 16.

If the top cover 10 is connected to the receptacle 18, the inner face 71 of the top cover 10 may maintain a position of the pipe 19 in the second cavity, may maintain a position of the lighter 100 in the third cavity 33, and/or may maintain a position of the cleaning pick 16 in the fourth cavity 34. For example, if the top cover 10 is connected to the receptacle 18, the inner face 71 of the top cover 10 may contact the pipe 19, the lighter 100 and/or the cleaning pick 16 to prevent movement of the pipe 19, the lighter 100 and/or the cleaning pick 16 relative to the receptacle 18, respectively.

In an embodiment, the depth 42 of the second cavity 32, the depth 43 of the third cavity 33, and/or the depth 44 of the fourth cavity 34 may be approximately equal. The depth 42 of the second cavity 32, the depth 43 of the third cavity 33, and/or the depth 44 of the fourth cavity 34 may be any depth.

Connection of the top cover 10 to the top end 20 of the receptacle 18 may limit and/or may prevent access to the second cavity 32, the third cavity 33 and/or the fourth cavity 34. Removal of the top cover 10 may provide access to the second cavity 32, the third cavity 33 and/or the fourth cavity 34. For example, the top cover 10 may have third threads 103, and/or the top end 20 may have fourth threads 104. The third threads 103 and/or the fourth threads 104 may be directly connected to the top cover 10 and/or the top end 20, respectively. For example, the third threads 103 and/or the fourth threads 104 may be integral with the bottom cover 11 and/or the top end 20, respectively.

The third threads 103 may connect to the fourth threads 104 to connect the top cover 10 to the top end 20 of the receptacle 18. The third threads 103 may disconnect from the fourth threads 104 to disconnect the top cover 10 from the top end 20 of the receptacle 18. For example, rotation of the top cover 10 in a first direction relative to the top end 20 of the receptacle 18 may disconnect the third threads 103 from the fourth threads 104 to disconnect the top cover 10 from the top end 20 of the receptacle 18. The top cover 10 may be rotated relative to the top end 20 of the receptacle 18 in a second direction opposite to the first direction. Rotation of the top cover 10 in the second direction may re-connect the third threads 103 to the fourth threads 104 to re-connect the top cover 10 to the top end 20 of the receptacle 18.

The third threads 103 and/or the fourth threads 104 may be helical. The third threads 103 may be angled relative to the top cover 10 at approximately the same angle that the fourth threads 104 are angled relative to the top end 20 of the receptacle 18. In an embodiment, the third threads 103 may be male threads, and the fourth threads 104 may be female threads. For example, the third threads 103 may extend in a direction generally outward from the top cover 10, and/or the fourth threads 104 may extend in a direction generally inward into the top end 20 of the receptacle 18. The third threads 103 may insert into the fourth threads 104 to connect the first threads 101 to the fourth threads 104.

In another embodiment, the third threads 103 may be female threads, and the fourth threads 104 may be male threads. For example, the third threads 103 may extend in a direction generally inward into the bottom cover 11, and/or the fourth threads 104 may extend in a direction generally outward from the bottom end 21 of the receptacle 18. The fourth threads 104 may insert into the third threads 103 to connect the fourth threads 104 to the third threads 103.

The top cover 10 may have a top o-ring 110. The top o-ring 110 may be a loop which may have a disc-shaped cross-section. The top o-ring 110 may be made from any material. In an embodiment, the top o-ring 110 may be an elastomer, such as, for example, silicone. The top o-ring 110 may be located between the fourth threads 104 and the top end 20 of the receptacle 18. The top o-ring 110 may be compressed if the top cover 10 connects to the top end 20 of the receptacle 18, and/or the top o-ring 110 may create a seal between the top cover 10 and the top end 20 of the receptacle 18. The top o-ring 110 may prevent and/or may hinder odor from exiting the receptacle 18 and/or may prevent water and/or other liquids from entering the receptacle 18.

As previously set forth, the teeth 35 may extend from the inner face 71 of the top cover 10 and/or the inner face 71 of the bottom cover 11, and/or the teeth 35 may be rectangular protrusions and/or hexagonal protrusions. As shown in FIGS. 21-24, the top cover 10 and/or the bottom cover 11 may be used to grind, to divide and/or to separate the smoking material into smaller sizes. The smoking material may be placed on the inner face 71 of the top cover 10 or the bottom cover 11. Then, the top cover 10 may be connected to the bottom cover 11 so that the smoking material is located between the top cover 10 and the bottom cover 11.

The first threads 101 may connect to the third threads 103 to connect the bottom cover 11 to the top cover 10. For example, rotation of the bottom cover 11 in a first direction relative to the top cover 10 may connect the first threads 101 to the third threads 103 to connect the bottom cover 11 from the top cover 10.

The first threads 101 may be angled relative to the bottom cover 11 at approximately the same angle that the third threads 103 are angled relative to the top cover 10. In an embodiment, the first threads 101 may be male threads and the third threads 103 may be female threads. For example, the first threads 101 may extend in a direction generally outward from the bottom cover 11, and/or the third threads 103 may extend in a direction generally inward into the top cover 10. The first threads 101 may insert into the third threads 103 to connect the first threads 101 to the third threads 103.

In another embodiment, the first threads 101 may be female threads, and the third threads 103 may be male threads. For example, the first threads 101 may extend inward into the bottom cover 11, and/or the third threads 103 may extend outward from the top cover 10. The third threads 103 may insert into the first threads 101 to connect the first threads 101 to the third threads 103.

Connection of the top cover 10 to the bottom cover 11 may separate the smoking material into smaller sizes. For example, connection of the top cover 10 to the bottom cover 11 may decrease the distance between the top cover 10 and the teeth 35 of the bottom cover 11 and/or may decrease the distance between the bottom cover 11 and the teeth 35 of the top cover 11. As the distance between the top cover 10 and the teeth 35 of the bottom cover 11 decreases, smoking material located between the top cover 10 and the teeth 35 of the bottom cover 11 may be broken into smaller sizes. As the distance between the bottom cover 11 and the teeth 35 of the top cover 11 decreases, smoking material located between the bottom cover 11 and the teeth 35 of the top cover 11 may be broken into smaller sizes.

After connecting the top cover 10 to the bottom cover 11, the user may rotate the top cover 10 and/or the bottom cover 11 to rotate the teeth 35. For example, if rotation of the top cover 10 and/or the bottom cover 11 connects the top cover 10 to the bottom cover 11, the user may continue to rotate the top cover 10 and/or the bottom cover 11 to rotate the teeth 35. Rotation of the teeth 35 may separate the smoking material into smaller sizes.

Then, the first threads 101 may disconnect from the third threads 103 to disconnect the bottom cover 11 from the top cover 10. For example, the bottom cover 11 may be rotated relative to the top cover 10 in a second direction opposite to the first direction. Rotation of the bottom cover 11 in the second direction may disconnect the first threads 101 from the third threads 103 to disconnect the bottom cover 11 from the top cover 10. After disconnecting the bottom cover 11 from the top cover 10, the smoking material having the smaller sizes may be placed in the first cavity 12 for storage, transportation and/or use in the pipe 19.

In an embodiment, the top cover 10 and the bottom cover 11 may be provided without the receptacle 18. For example, the top cover 10 and the bottom cover 11 may be provided without the receptacle 18 as a "grinder" as known to one having ordinary skill in the art. The present invention does not require the receptacle 18 for the top cover 10 to be used with the bottom cover 11, and the top cover 10 and the bottom cover 11 may be provided or used in the absence of the receptacle 18 in some embodiments.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by this specification.

We claim:

1. A storage receptacle, the storage receptacle comprising:

a cylinder having a threaded top end and a threaded bottom end wherein the bottom end is located in a position opposite to the top end;

a first cavity in the bottom end wherein the first cavity has a first length and extends from the bottom end into the cylinder;

a second cavity in the top end wherein the second cavity has a cylindrical shape and further wherein the second cavity has a second length and extends from the top end into the cylinder to a position adjacent to the first cavity wherein the second length is at least two times longer than the first length;

a third cavity in the top end wherein the third cavity extends from the top end into the cylinder;

a bottom cover that covers the first cavity wherein the bottom cover is integrally formed of a top section, a thread section and a plurality of protrusions wherein the threaded section of the bottom cover attaches to the threaded bottom end and further wherein the plurality of protrusions extend into the first cavity in a direction perpendicular to the threaded section;

a top cover that covers the second cavity and the third cavity wherein the top cover attaches to the threaded top end.

2. The storage receptacle of claim 1 wherein the bottom cover attaches to the top cover.

3. The storage receptacle of claim 1 further comprising:

a plurality of protrusions that extend from the top cover.

4. The storage receptacle of claim 1 further comprising: a fourth cavity in the top end wherein the fourth cavity has a cylindrical shape and further wherein the fourth cavity extends from the top end into the cylinder.

5. A system comprising:

a storage receptacle having a top end and a bottom end wherein the bottom end is located in a position opposite to the top end and further wherein the storage receptacle has a cylindrical shape;

a first cavity in the bottom end wherein the first cavity has a first length that extends from the bottom end into the storage receptacle wherein the first cavity has a cylindrical shape and further wherein the first cavity has a diameter approximately equal to the diameter of the storage receptacle;

a second cavity in the top end wherein the second cavity has a second length that extends from the top end into the storage receptacle wherein the second length is at least twice as long as the first length;

a third cavity in the top end wherein the third cavity has a third length that extends from the top end into the storage receptacle wherein the third length is at least twice as long as the first length;

a fourth cavity in the top end wherein the fourth cavity extends from the top end into the storage receptacle;

a bottom cover having a top face and a bottom face integral fastening members between the top face and the bottom face wherein the bottom cover fastens to the bottom end of the storage receptacle wherein the bottom face covers the first cavity and the bottom covers provides access to the first cavity;

a top cover having integral fastening members wherein the top cover fastens to the top end of the storage receptacle to cover the second cavity, the third cavity and the fourth cavity and to provide access to the second cavity, the third cavity and the fourth cavity and further wherein the top cover fastens to the bottom cover;

and a plurality of protrusions extending from the bottom cover in a direction substantially perpendicular to the bottom face of the bottom cover and into the first cavity.

6. The system of claim 5 further comprising: a cleaning pick having substantially the same dimensions as the fourth cavity.

7. The system of claim 5 further comprising: an o-ring connected to one of the top end and the top cover wherein the o-ring is located between the top end and the top cover.

8. The system of claim 5 further comprising: an o-ring connected to one of the bottom end and the bottom cover wherein the o-ring is located between the bottom the end and the bottom cover.

9. The system of claim 5 wherein the top end, the bottom end, the top cover and the bottom cover have the same circular shape.

10. The system claim 5 wherein the top cover has a diameter, the bottom cover has a diameter and the storage receptacle has a diameter and further wherein the diameter of the top cover, the diameter of the bottom cover and the diameter of the receptacle are approximately equal.

11. The system of claim 5 further comprising: threads integral with at least one of the top cover and the to end wherein the threads enable the top cover to fasten to the top end.

12. The system of claim 5 further comprising: threads integral with at least one of the bottom cover and the bottom end wherein the threads enable the bottom cover fasten to the bottom end.

13. The system of claim 5 further comprising: threads integral with at least one of the top cover and the top end wherein the threads enable the top cover to reversibly attach and separate from the top end.

14. The system of claim 5 wherein the fourth cavity has a cylindrical shape.

15. The system of claim 5 further comprising: plurality of protrusions extending from the top over and.

* * * * *